US005103879A

United States Patent [19]

Hickerson

[11] Patent Number: 5,103,879

[45] Date of Patent: Apr. 14, 1992

[54] PILLOW FILLING ARRANGEMENT

[76] Inventor: Eugene E. Hickerson, P.O. Box 29, Leachville, Ak. 72438

[21] Appl. No.: 588,712

[22] Filed: Sep. 27, 1990

[51] Int. Cl.[5] ..... B65B 1/16

[52] U.S. Cl. ..... 141/67; 141/114; 406/28; 406/154

[58] Field of Search ..... 141/67, 68, 83, 114; 406/18, 22, 28, 154, 171

[56] References Cited

U.S. PATENT DOCUMENTS

| | | | |
|---|---|---|---|
| 3,693,836 | 9/1972 | Eisner | 141/67 X |
| 4,127,220 | 11/1978 | Werthaiser et al. | 141/83 X |
| 4,664,160 | 5/1987 | Rothstein et al. | 141/67 |
| 4,799,830 | 1/1989 | Fuss | 141/67 X |

*Primary Examiner*—Ernest G. Cusick
*Assistant Examiner*—Robert M. Fetsuga
*Attorney, Agent, or Firm*—Warren D. Flackbert

[57] ABSTRACT

A pillow filling arrangement characterized by a hopper into which filler material is introduced and caused to fluff by a pusher fan(s), resulting in optimum buoyancy and loft. Consistent filler material weight is achieved due to preestablished timer action, such being without the necessity of physical weighing and largely irrespective of the type of filler material involved. Additionally, the arrangement is operated from a single main control, usable in both manual and automatic modes, and representing a convenience in satisfying all operational needs at the same location.

8 Claims, 2 Drawing Sheets

PILLOW FILLING ARRANGEMENT

BACKGROUND OF THE INVENTION

As is known, pillows, in a variety of shapes and forms, and, as well, with different filler material, are in widespread usage and commonly found serving decorative and utilitarian purposes. A need has arisen for developing efficient equipment for the mass production of pillows, where usually, air usage, as in the form of blowing and/or a vacuum, serves to transfer the filler material from a distribution hopper, through various feed lines typically controlled by selectively actuated valves, to a filling machine.

DESCRIPTION OF THE INVENTION

The present invention serves to achieve pillow filling at a weight accuracy and filling rate more optimum than achievable heretofore, involving an arrangement including a picker bin for receiving filler material from an outside source; a hopper into which the filler material is moved; a series of push fans controlling filler material movement throughout the arrangement, and, importantly, for purposes of fluffing within the hopper; shuttle valves; timers serving various end purposes; and, a main source or supply of air.

The arrangement includes a single control panel location for positively assuring performance of the desired operational steps.

While certain vacuum features are inherently involved with the instant arrangement, the total mechanism is probably more identifiable as a fan controlled air pushing system.

DESCRIPTION OF THE FIGURES

In any event, a better understanding of the present invention will become more apparent from the following description, taken in conjunction with the accompanying drawings, wherein.

Figure 1:
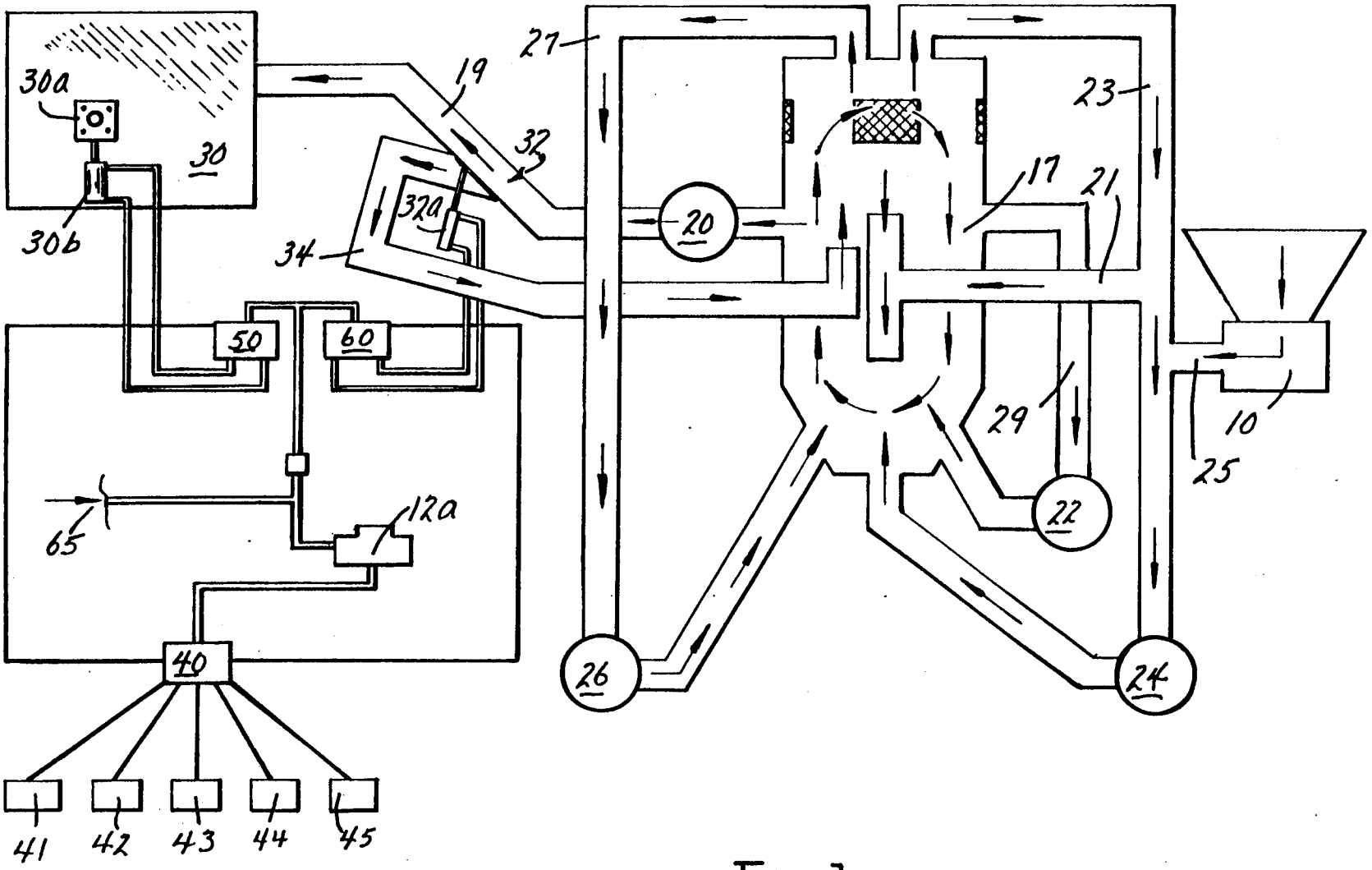
FIG. 1 is a schematic diagram of a pillow filling arrangement in accordance with the teachings of the present invention; and, FIG. 2 is a perspective view generalizing the mechanical components in a typical operational setup.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the figures, and particularly the schematic diagram of FIG. 1, the invention utilizes a series of ducts, offering various paths (described below), for transferring filler material (not shown) manually introduced into a picker bin 10 to a pillow filling machine 30.

A main starter switch, located on a control panel 12 (see FIG. 2), serves to initiate overall operation, where such also serves emergency stopping purposes (when a stop switch is actuated). In other words, and importantly, the operation of the push fans, to be described herebelow, the filling machine 30 and the picker bin 10 can each be easily started and/or stopped from a single main control panel 12 location.

The aforesaid push fans, identified by reference numerals 20, 22, 24 and 26, are each selectively energized by control switches (not shown), located on the control panel 12, serve the following purposes:

Upon operation of control switch for push fan 20, the air from the latter will transfer fluffed filler material from hopper 17 and pass such through "Y" gate 32 either for pillow filling or, through bypass 34, for recirculation and/or return to the hopper 17.

Upon operation of control switch for push fan 22, the air from the latter will transfer filler material from hopper 17, fluff such and blow it back into the hopper 17.

Upon operation of control switch for push fan 24, the air from the latter will transfer filler material from hopper 17, fluff such and blow it back into the hopper 17.

Upon operation of control switch for push fan 26, the air from the latter will transfer filler material from hopper 17, fluff such, and then return it into the hopper 17.

Another switch (not shown) located on control panel 12 activates picker fan (not shown) action, i.e. fluffs filler material and serves to blow such from the picker bin 10 into the hopper 17.

Thus, the invention significantly contributes to optimum pillow filling by providing a hopper 17 for selective pillow filler material fluffing, in desired paths, i.e. to tear apart the fibers for assuring resiliency and loft, and, at the same time, maintaining accurate consistent filled weight, where the latter is not accomplished by weighing, but, instead, by the time interval developed for timer action.

It should be understood that the instant arrangement is effectively usable with filler material normally subject to undesirable compacting after release from a baled transporting condition, as e.g. polyester, shoddy or dark polyester cotton, white polyester cotton, and cotton waste.

Figure 2:
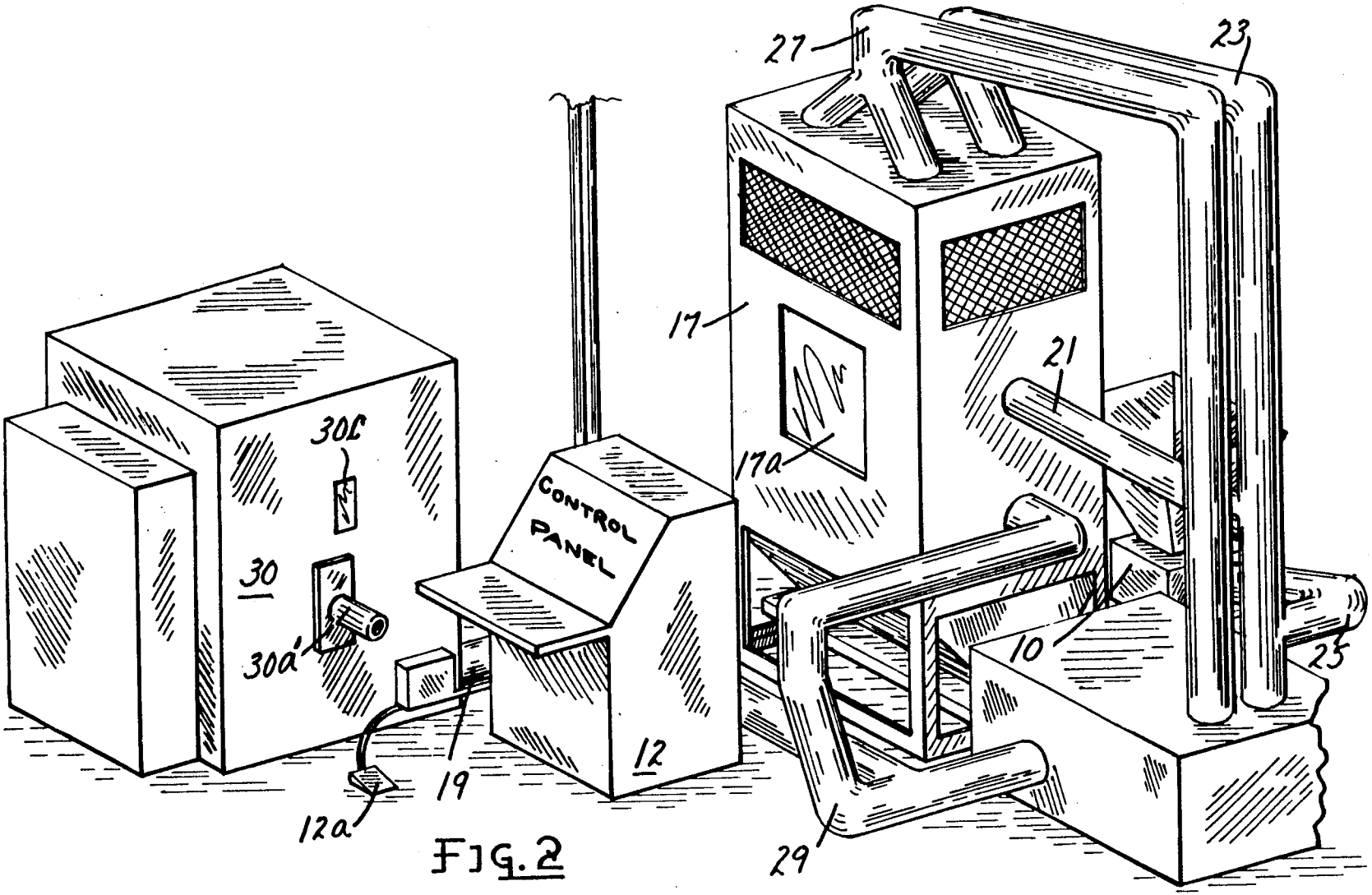

FIG. 2 further illustrates the overall equipment forming part of the pillow filling arrangement of the invention, as the earlier mentioned control panel 12, the hopper 17 communicating through ducts (19, 21, 23, 25, 27, 29) to picker bin 10, and the mechanism, i.e. fill gate **30*a* and fill gate cylinder 30*b*, which controls the introduction of filler material into a pillow casing (not shown) communicating with a filling tube 30*a*'**.

The latter may be achieved by different approaches, where, as already stated, the arrangement herein plays importance in providing hopper 17 turbulence, for filler fluffing, and the use of a single main control panel 12 for selecting operational stages. As to the latter, note that a foot pedal **12*a*** is typically used in conjunction therewith.

In any event, other components serving operational control for pillow filling include, in addition to foot pedal **12*a*, an air valve controlled microswitch 40 operatively connecting a "Y" timer 41, a fill timer 42, a dwell timer 43, a reduction counter 44, and a total counter 45**.

Foot pedal **12*a* selectively transfers pressurized air to a shuttle valve 50, operatively controlling fill gate 30*a* through fill gate cylinder 30*b*. Foot pedal (12*a*) controlled shuttle valve 60 serves to control "Y" gate 32 (in the form of a pivotal diverter plate [not detailed]permitting filler material flow to filling machine 30 or the return or recirculation thereof, through 34, to the hopper 17) through operation of "Y" gate cylinder 32***a*. Main air inlet line is indicated by arrow 65.

As a matter of operation, when, for example, foot pedal 12*a* is depressed, air passes through a valve (not shown) in the pedal 12*a*, actuating microswitch 40 and causing the following sequence of events:

(1) a "Y" gate timer 41 is initiated, whereupon shuttle valve 60 opens and permits passage of air to "Y" gate cylinder 32*a*, opening normally closed "Y" gate 32. "Y" gate 32 then permits filler material to pass from the hopper 17 to the filling machine 30, where, after a preset time, filler material is no longer moved;

(2) filler timer 42 is initiated, whereupon shuttle valve 50 opens, permitting air to pass to fill gate cylinder 30*b*, and, thereby, opening the fill gate 30*a* and the passage of filler material. The latter stays open until a preset timer terminates the circuitry, ceasing passage of filler material; and, (3) initiates total counter 45 which serves to sum production.

As a matter of kindred interest, the control panel 12 includes both a manual and automatic mode, where the aforesaid dwell time counter 43 and the reduction counter 44 only work when the equipment is in the automatic mode. In such instance, the timer 41 for the "Y" gate 32 or the timer 42 for the fill gate 30*a* (whichever comes on first) will start the dwell timer 43 and also deduct the number of filled pillows evidenced by reduction counter 44.

As a matter of added automation, the reduction counter 44 will then initiate the timer 41 for the "Y" gate 32 and timer 42 for the fill gate 30*a*, where, with shuttle valve 50,60 operation, both the "Y" gate 32 and the fill gate 30*a* remain open, adding such pillow production on the total counter 45.

Further automatic operation is achieved by setting the desired multiple number on the reduction counter 44 by depressing foot pedal 12*a* (as one time). The latter permits the reduction counter 44 to take over and continue pillow filling as long as there is more than one number on the counter, i.e. until the counter 44 reads 000.

From the preceding, it should be apparent that the invention consistently measures a desired filler volume with high accuracy, irrespective of pillow cavity size and the particular filler material utilized, as the aforementioned shoddy and cotton waste, based on a time interval and not a weighing procedure. Additionally, the invention permits effective pillow filling control at a single location. Importantly, the hopper 17, with its myriad passageways for filler material flow due to push fan operation, readily accomplishes fluffing of the filler material, meaning that the latter will exhibit desired physical properties of buoyancy and loft.

The operational sequence is further enhanced by sight windows 17*a* on opposite sides of the hopper 17; and, a sight window 30*c* on filling machine 30, each serving to visually evaluate the filling availability of the arrangement.

The pillow filling arrangement described hereabove is susceptible to various changes within the spirit of the invention, including, by way of example, the number of push fans involved; the positioning of the ducts with respect to the hopper for optimum filling material fluffing; the precise form of "Y" gate employed (controlling pillow filling or filler material recirculation); the fact that the filling machine and pusher fan may assume other forms; and, the like. Thus, the preceding should be considered illustrative and not as limiting the scope of the following claims:

I claim:

1. A pillow filling arrangement comprising a picker bin, a hopper, a filling machine and control mechanism, where said picker bin communicates with said hopper, where blower means and associated conduits variously interconnect said picker bin and said hopper in a filler material fluffing relationship, where said blower means is actuated by said control mechanism, where said hopper communicates through a conduit with said filling machine to achieve passage of fluffed pillow filling, where diverter means operably associated with said conduit between said hopper and said filling machine selectively permits filler material passage to said filling machine or to said hopper, and where said diverter means is also actuated by said control mechanism.

2. The pillow filling arrangement of claim 1 where filled weight is dependent upon timing preestablished by an operator.

3. The pillow filling arrangement of claim 1 where pillow filling is initiated by a timer of said control mechanism.

4. The pillow filling arrangement of claim 1 where said control mechanism is at a single location.

5. The pillow filling arrangement of claim 1 where said control mechanism is selectively operable at automatic and manual modes.

6. The pillow filling arrangement of claim 1 where said control mechanism includes a microswitch, and where a timer controlling filled weight is responsive to the actuation of said microswitch.

7. The pillow filling arrangement of claim 1 where said arrangement operates from a source of air.

8. A pillow filling arrangement comprising a picker bin, a hopper, a filling machine and control mechanism, where said picker bin communicates with said hopper, where blower means and associated conduits variously interconnect said picker bin and said hopper in a filler material fluffing relationship, where said hopper communicates through a conduit with said filling machine to achieve passage of fluffed pillow filling, where diverter means operably associated with said conduit between said hopper and said filling machine selectively permits filler material passage to said filling machine or to said hopper, where said blower means and said diverter means are actuated by said control mechanism, and where said diverter means includes an operating cylinder.

* * * * *